US011612192B2

(12) United States Patent
Bardini

(10) Patent No.: US 11,612,192 B2
(45) Date of Patent: Mar. 28, 2023

(54) GARMENT FOR CYCLISTS

(71) Applicants: SCISSORS LLC AUSTIN TEXAS SUCCURSALE DI CHIASSO, Chiasso (CH); Bruno Bardini, Gentilino Lugano (CH)

(72) Inventor: Bruno Bardini, Gentilino Lugano (CH)

(73) Assignee: TRERÈ INNOVATION S.R.L., Asola (IT)

( * ) Notice: Subject to any disclaimer, the term of this patent is extended or adjusted under 35 U.S.C. 154(b) by 1212 days.

(21) Appl. No.: 15/508,643

(22) PCT Filed: Sep. 9, 2015

(86) PCT No.: PCT/IT2015/000218
§ 371 (c)(1),
(2) Date: Mar. 3, 2017

(87) PCT Pub. No.: WO2016/038640
PCT Pub. Date: Mar. 17, 2016

(65) Prior Publication Data

US 2017/0258144 A1 Sep. 14, 2017

(30) Foreign Application Priority Data

Sep. 12, 2014 (IT) ..... MN2014A000007

(51) Int. Cl.
*A41B 9/12* (2006.01)
*A41D 1/084* (2018.01)
(Continued)

(52) U.S. Cl.
CPC ..... *A41B 9/12* (2013.01); *A41B 9/001* (2013.01); *A41B 9/023* (2013.01); *A41D 1/084* (2013.01);
(Continued)

(58) Field of Classification Search
CPC ..... A41B 9/12; A41B 9/001; A41B 9/023; A41B 2400/22; A41B 9/14;
(Continued)

(56) References Cited

U.S. PATENT DOCUMENTS 2,427,428 A 9/1947 Vitale
3,489,149 A * 1/1970 Larson ..... A61F 13/72 604/394
(Continued)

OTHER PUBLICATIONS

International Search Report dated Jan. 27, 2016 in International Application No. PCT/IT2015/000218.

*Primary Examiner* — Khoa D Huynh
*Assistant Examiner* — Aiying Zhao
(74) *Attorney, Agent, or Firm* — Wenderoth, Lind & Ponack, L.L.P.

(57) ABSTRACT

A garment for a cyclist includes an elasticized or elastic edge for adhering to a body of the cyclist so as to ensure that an entire structure of the garment does not move during pedaling, a pair of strips made of a fabric or a suitable material designed to rest against buttocks of the cyclist and engaged at one end with a rear part of the elasticized or elastic edge, a front portion connected to the pair of strips at a first end and connected to a front part of the elasticized or elastic edge at a second end and set up to be positioned on a genital zone of the cyclist with a series of zones with different processing textures. The garment further includes a protective pad shaped and located between the front portion and the pair of strips and including padding having different thicknesses.

18 Claims, 4 Drawing Sheets

(51) Int. Cl.
*A41B 9/00* (2006.01)
*A41B 9/02* (2006.01)
*A41D 13/05* (2006.01)

(52) U.S. Cl.
CPC ..... *A41D 13/0556* (2013.01); *A41B 2400/22* (2013.01)

(58) Field of Classification Search
CPC ..... A41B 2300/32; A41D 1/084; A41D 13/0556; A41D 13/0525; A41D 13/0562; A41D 13/0568; A41D 13/0575; A41D 2600/104; A63B 71/1216
USPC ..... 2/403, 466, 113, 73; 602/67, 68, 70, 73
See application file for complete search history.

(56) References Cited

U.S. PATENT DOCUMENTS 4,229,835 A * 10/1980 Shaw ..... A41B 9/001 2/221
4,679,554 A * 7/1987 Markham ..... A61F 5/40 602/70
5,524,298 A * 6/1996 Plunkett ..... A41B 9/023 2/400
6,334,223 B1 1/2002 Pieri
7,404,216 B1 * 7/2008 Paramore ..... A63B 71/1216 2/406
2002/0053102 A1 * 5/2002 Vartanyan ..... A41B 9/02 2/403
2004/0143890 A1 * 7/2004 Reschewitz ..... A41D 1/084 2/466
2005/0009446 A1 * 1/2005 Arnold ..... A41B 9/001 450/100
2005/0142986 A1 * 6/2005 Belpaume ..... A41D 7/005 450/99
2011/0265255 A1 * 11/2011 Hyndman ..... A41B 9/12 2/466
2012/0233752 A1 * 9/2012 Kemma ..... A41D 1/084 2/465
2013/0000025 A1 * 1/2013 Garneau ..... A41D 1/084 2/466
2015/0074881 A1 * 3/2015 Lupcho ..... A41D 13/0537 2/455
2016/0219950 A1 * 8/2016 Lucchini ..... A41D 13/05
2017/0135420 A1 * 5/2017 Peng ..... A41D 1/084

* cited by examiner

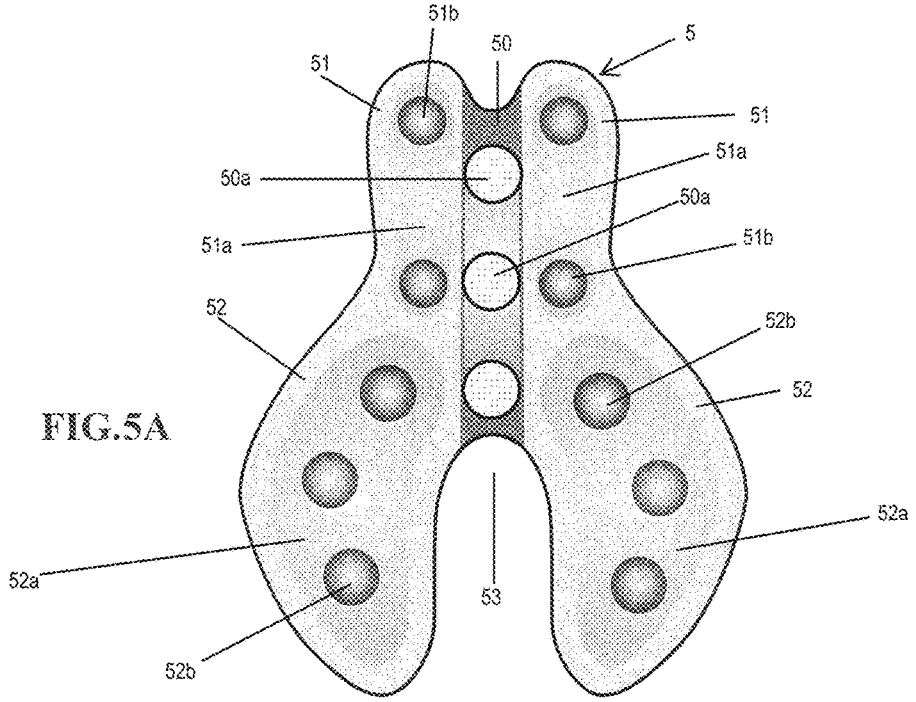
FIG.5A
FIG.5B
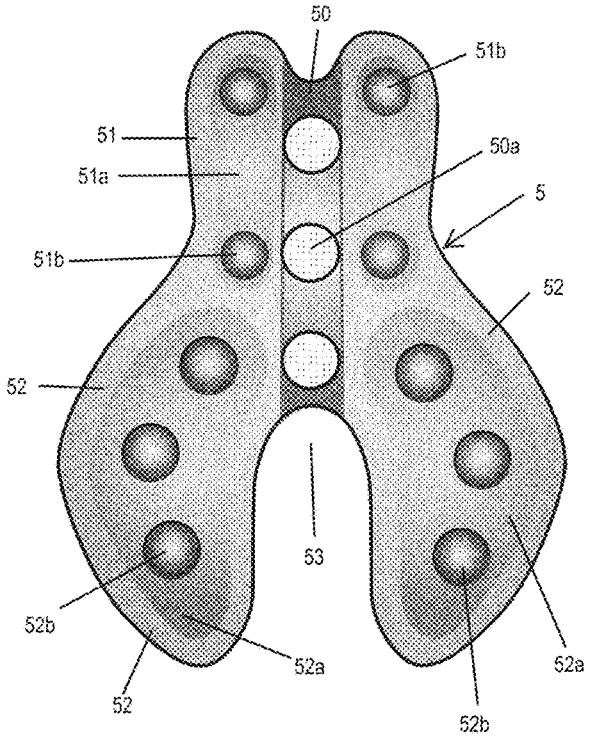
FIG.5C
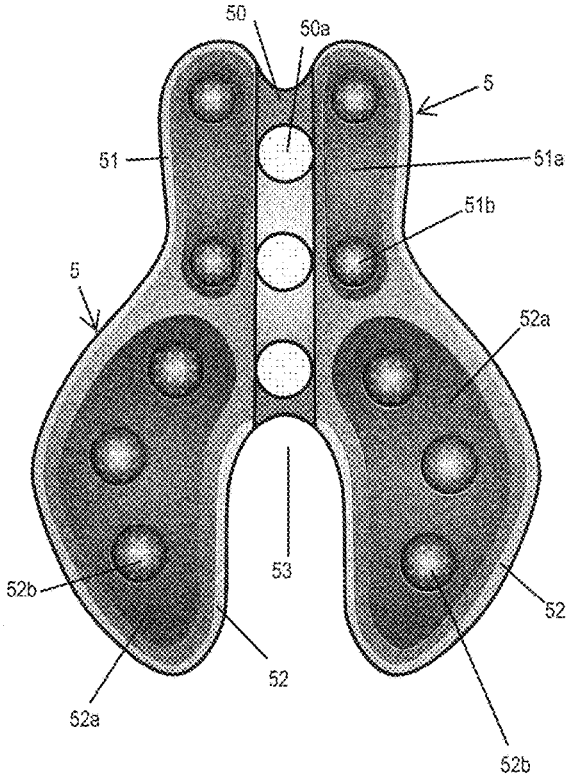

GARMENT FOR CYCLISTS

TECHNICAL FIELD

The present invention relates to a garment for cyclists that is particularly suitable for being able to be worn with any trousers in order not to restrict persons wishing to ride a bicycle from using trousers with built-in protection, offering good protection of the genital, perineal and ischial zones of both professional, amateur and occasional cyclists.

BACKGROUND ART

Over the last few years, two phenomena have spread in the world of the bicycle: the city bike and the touring bike. The former is linked to the need to move freely around urban areas with due consideration for the environment; the latter is due to the desire to get back into contact with the world around us. In both cases, in order to enjoy pedaling fully, it is important to wear suitable protection.

As is known, the main element with which the cyclist is in contact during pedaling is undoubtedly the saddle, which has three very important zones that enable comfort to be offered to the cyclist. The first is the "nose of the saddle", which has the characteristic shape of a formed beak to provide a flat base for exertions whilst sitting down when long ascents have to be tackled and acts as a help in descents as it enables the bicycle to be controlled better with the thighs. The second part is the "central channel" that enables the organs of the genital zone not to suffer any crushing. Lastly, the third is the seat, which bears the weight of the body of the cyclist between the buttocks and the lower part of the ischial tuberosities. The seating position is favored by the formed rear profile of the saddle so as to avoid crushing of the coccyx on bumpy terrain. It is known that the ischial tuberosities of the pelvis constitute the structural supporting point of the skeleton on the saddle. Studies have shown that the distance between the apices of the tuberosities varies from person to person, depending on the size of the pelvis and a survey of 200 adults found that the average distance was 12.5 cm, with minimum values of 11 cm and maximum values of 14.5 cm. In view of this, it is important for the saddle to have the correct dimensions to ensure stable seating and appropriate pressure on the genital and pubic zone.

In fact, on the resting surface, which measures just a few square centimetres, there are bones, muscles, tendons, cartilage and containing structures thereof and in the course of a normal bicycle ride these organs and structures are subjected to prolonged compression stress and jolt traumas.

The resulting pressure causes problems like nerve compression syndromes in the form of numbness of the genitalia, suffered by 50-91% of cyclists, followed by erectile dysfunction, which is reported in 13-24% of cases. This is due to constant perineal pressure that indirectly compresses the pudendal nerve, increasing the friction inside the Alcock channel. Further, the direct pressure of the front portion of the saddle on the perineum and on the pubic symphysis, further accentuated by the tilt forwards of the cyclist, compresses the pudendal nerve exactly in the point in which it emerges behind the pelvic bone, compressing the prostate and bladder.

One good help for solving the previously illustrated problems is provided by the saddles found on the market of the "complete cut-out" type that enable the front pressure to be eliminated, in the perineal and pelvic zone, without a significant increase in the pressure in the rear part, but they create a considerable feeling of instability that leads to other types of stress and further tiring of the cyclist.

As previously mentioned, the problems of the perineal zone in cyclists can be of a nervous type but also be of a circulatory nature. In the former case, during pedaling, with the thigh extending backwards, stretching of the pubic nerve may be obtained that may lead to numbness of the genitals and of the lower limbs, if it is not properly protected. In the latter case, the possible problems of a circulatory nature depend on the weight of the body of the cyclist, who by resting on the saddle may cause peripheral arterial disease as correct supply of blood and oxygen to the entire zone of the genitalia may be prevented with consequent start of inflammation because of reduced blood flow that produces an increase in lactic acid that considerably reduces resistance to exertion, causing a significant loss of muscular power or unpleasant mechanical malfunctions that tend to become chronic.

In order to overcome the previously illustrated problems, trousers have been made for some time for cyclists that have reinforcements and padding to protect the previously mentioned zones. The protections are defined as the bottom and are a very important element first of all for the health of the cyclist but also for improved performance.

In fact, today, various studies show how an incorrect and unsuitable protection of the cyclist on the saddle can have an adverse effect and over time the cyclist may start to have uncoordinated movements with loss of energy and greater consumption of oxygen that limits performance and resistance to exertion.

Further, the discomfort and problems illustrated previously for cyclists who use bicycles a lot also occur to a lesser extent in occasional users and in those who use bicycles as a means of transport around town. Although such discomfort is less, it tends to persist over time even after pedaling has stopped because the muscles, the bones, etc. are less trained and prepared for the exertion than those of professional or habitual cyclists. Further, whilst professional and amateur cyclists use trousers provided with special padded bottoms, to go to work or move around the city, city cyclists hardly have the possibility to wear suitable protection, so they experience all the discomfort disclosed previously much more rapidly, which discomfort tends to remain even at work and they may experience discomfort or pain, for example, from sitting in the office.

In particular, current protections in shorts for cyclists are particularly bulky and decidedly aesthetically unappealing and in addition they affect the correct kinetic movement of pedaling.

In addition to what has been illustrated so far, many shorts on the market do not provide suitable protection for the genitalia of the cyclist, entailing incorrect positioning of the genitalia, which are crushed and tend to be placed between the thigh of the cyclist and the saddle, leading to continuous and repeated rubbing and a condition of constriction that leads over time to unpleasant irritation, discomfort and malfunctions of the urogenital apparatus, especially for cyclists who spend many hours in the saddle, whether professionals or amateurs.

Further, it has been found that repeated microtraumas and compression in the sciatic arch lead, over time, to bursitis that causes pain and discomfort even after finishing the cycling that sometimes leads to limits to work activities. In addition, if the ischium is not supported correctly, the load transfers to the vertebral column, which causes other painful problems. Lastly, continuous rubbing, together with sweating and ischaemia from compression can give rise to painful skin ulcers that force the sporting activity to be interrupted.

As is known, today, users are very interested in all the garments and accessories that are comfortable, practical, functional, of pleasing appearance and flexible in use.

In addition to what has been said so far, it is known how the enthusiasts of this type of sport are particularly demanding and attentive in choosing clothing and accessories to go with their bicycles, so they are certainly not prepared to accept compromises in clothing that does not match their expectations and requirements.

SUMMARY OF INVENTION

One object of the present invention is substantially to solve the problems of the prior art by overcoming the difficulties disclosed above by means of a cycling garment that can be worn with any trousers to provide excellent optimum protection of the genital, perineal and ischial zones of the cyclist.

A second object of the present invention is to make a garment for cyclists that can adapt perfectly to the shape of the body, fill any space between the body and the saddle and form an extremely comfortable air pad between the body and the saddle.

Another object of the present invention is to make a garment for cyclists that enables the user to obtain significant comfort when in the saddle.

A further object of the present invention is to make a garment for a cyclist that can be donned and removed simply and rapidly.

By no means, the last object of the present invention is to make a garment for cyclists that is easy to make and is functional.

These objects and still others, which will become more apparent in the course of this description, are substantially achieved by a garment for cyclists, as described below.

BRIEF DESCRIPTION OF DRAWINGS

Further features and advantages will become clearer from the detailed description of a garment for cyclists, according to the present invention, given here below with reference to the attached drawings, which are provided merely by way of example, and are therefore non-limiting, in which:

FIGS. 5A, 5B and 5C each show a version of the level of protection provided by the garment for cyclists in question.

BEST MODE FOR CARRYING OUT THE INVENTION

Figure 1:
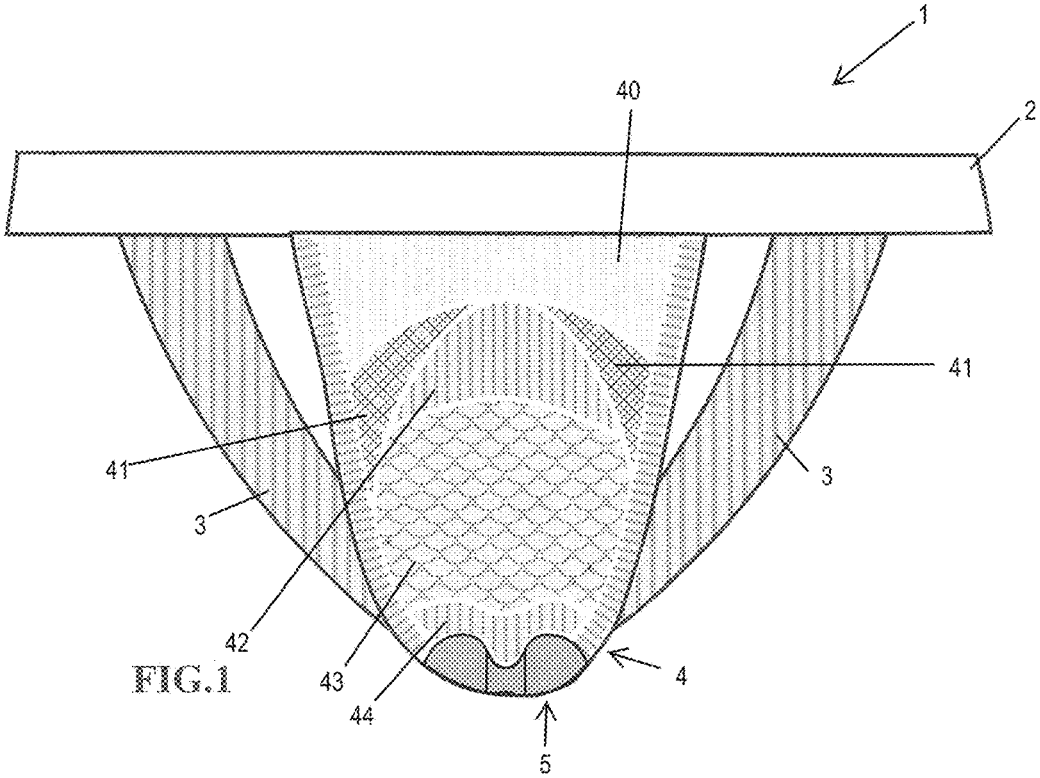
FIG. 1 shows in a schematic manner and in a front view, a garment for cyclists according to the present invention.
Figure 2:
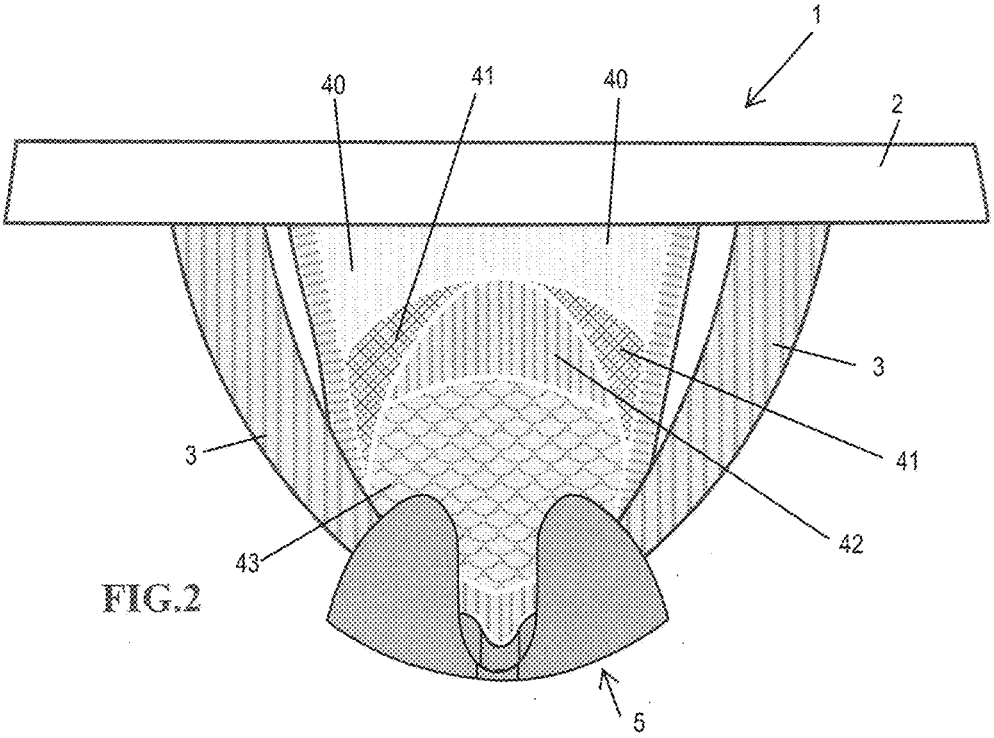
FIG. 2 shows in a schematic manner and in a rear view, the garment for cyclists of FIG. 1.

With reference to the figures mentioned, and in particular to FIG. 1, with 1 a garment has been indicated overall for cyclists according to the present invention.

The garment for cyclists 1 in question substantially consists of an elasticized or elastic edge 2 provided to adhere to the body of the user to ensure that the entire structure of the garment does not move during pedaling. In particular, the edge 2 can be provided with closures 20 such as buttons, Velcro, hooks or other things the function of which will be illustrated below.

Figure 3:
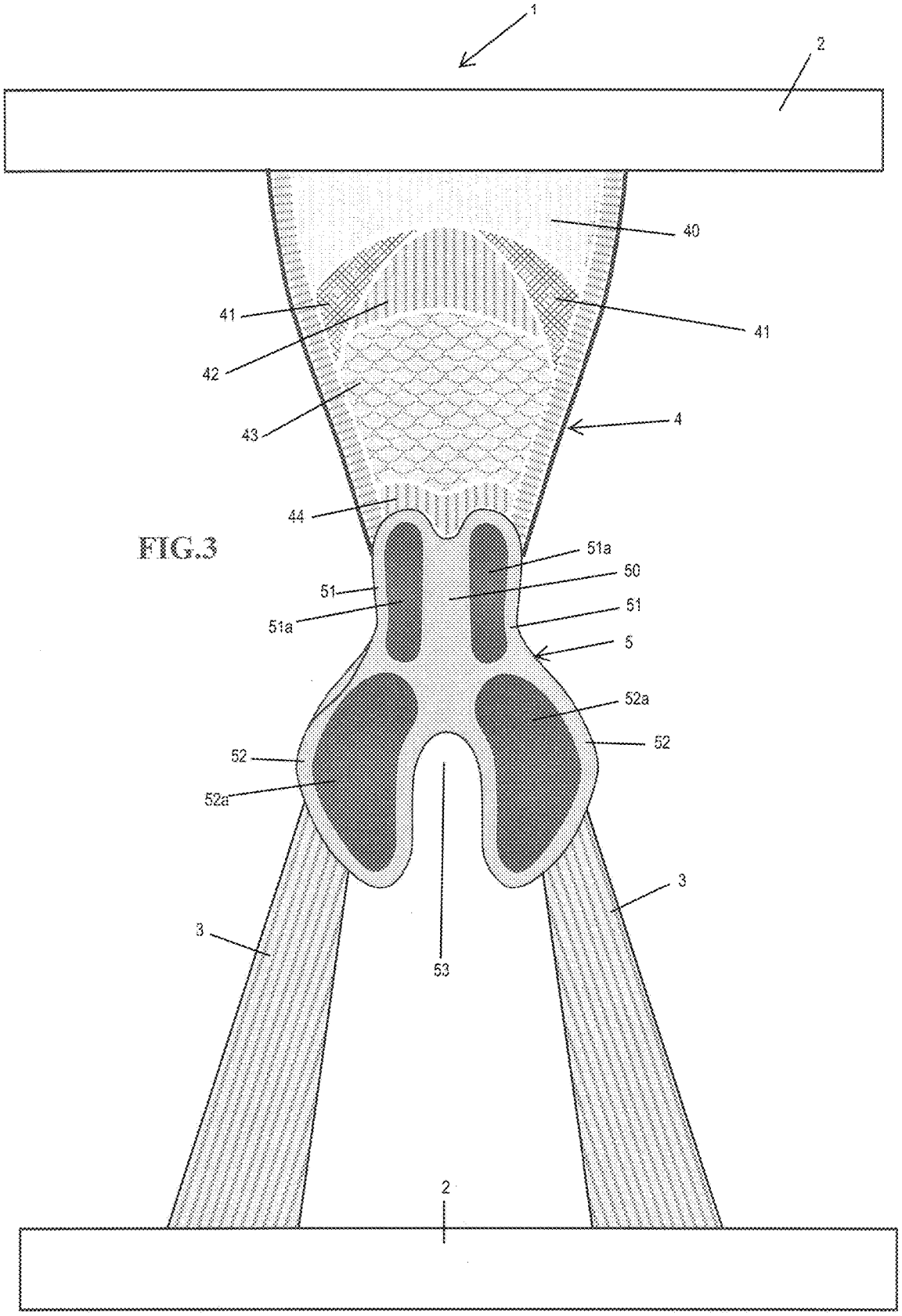
FIG. 3 shows in a schematic manner an overall view of the garment of FIG. 1.

With the elastic edge there are engaged at the rear, as shown in FIG. 3, a pair of strips 3 made of woven material or elastics or of another fabric or suitable material set up for the purpose to connect to a front portion 4 the other end of which is engaged on the elastic edge 2 in the front part.

In particular, the pair of strips 3 is set up to support the buttocks of the cyclist whereas the front portion 4 is set up for positioning itself on the genital zone of the user.

In the present embodiment, the front portion 4 has a substantially trapezoidal conformation and has a series of zones with different types of processing, as shown in FIG. 3, that enable various functions to be diversified such as breathability, containment and support. More in detail, in the front portion 4 there is a first zone 40 placed in contact with the edge 2 from which a second zone 41 is detached that is divided into two sectors configured as a sliver having a different knit weave from the first zone 40. The second zone 41 adjoins a third zone 42 and a fourth zone 43 that create a shell for receiving the genitalia in the male version of the garment.

In the male version, the third zone 42 and the fourth zone 43 have a suitable concave shape for inviting the genitalia to adopt a slightly raised and compact position in this place, separating the genitalia from the thighs so as to avoid that, during pedaling, the two-sided elastic fabric with which the trousers for cyclists are made can continuously "stress" the genitalia by irritating them through the effect of the pressure and the tension—from the right to the left—caused by the elastomer (elastic incorporated into the fabric).

Further, the scrotum and the thus positioned genitalia avoid receiving blows and stress in the lower portion from the tip of the saddle, they are not compressed by the muscular action, they are subjected to a lower temperature inasmuch as they are no longer to subject to rubbing and compression. In this manner, skin irritation, edemas and swellings of both the testicular areas and of the various body ducts are avoided.

The front part 4 can be divided into sectors in a different manner from what has just been illustrated, depending on the type of processing and functions attributed.

In fact, there is a difference between the male and female versions of the garment for obvious reasons, both in wear and design. The different sectors are joined together without stitching for greater comfort of the user, but when necessary for particular reasons they can have stitching in order to be able, for example, to insert particular materials such as a net.

Further, the front portion 4 comprises a fifth zone 44 placed between the fourth zone 43 and the pair of strips 3 provided for anchoring a protective pad 5.

As previously mentioned, the different zones of the front part 4 have different processing with mesh points that can differ according to the use in various sporting disciplines and in the male or female versions of the garment. In fact, the different weaves of the various zones are provided so that the absorbed sweat is expelled rapidly without remaining in contact with the skin for a long period.

According to the present invention, the garment 1 comprises a protective pad 5 that can be fixed or is removable and which is located with the front end at the fifth zone 44 and with the rear zone at the strips 3.

As shown in FIGS. 5A, 5B and 5C, the protective pad 5 has a central anti-collapsing channel 50 provided to prevent the two side portions folding on one another and is provided with at least one ventilating sector 50*a* or with a portion in which the weave is broad for an optimum air flow that favors good and correct breathing so as to eliminate completely overheating of the zone between the buttocks.

In the present embodiment there are three breathing sectors.

In detail, the channel 50 has on each side a shaped and padded side portion that is divided into two parts. The first front part 51 consists of first padding 51*a* having a substantially rectangular conformation and being arranged parallel to the front part of the central channel 50 with different and increasing thicknesses and with at least one pair of reinforcements 51*b* whereas the second rear part 52 is shaped, "as a snug fit" in the present embodiment, and has second padding that tends to increase going to the center with the reinforcements 52*b*. In particular, both the reinforcements 51*b* and the reinforcements 52*b* are provided with a padding thickness that is greater than the other zones and can be pierced so as also to be breathable.

As disclosed previously, the protective pad 5 has padding having different thicknesses in which the thickness is greater towards the center of the padded portion placed at the support of the buttocks on the saddle so as to support better and with greater comfort the perineal and ischial zones of the user.

In addition, with the same padding configuration, the thickness can be greater or reduced, depending on the desired level of protection. In fact, a basic padding version is provided, as shown in FIG. 5A, if the garment is provided for a use that is limited in time like, for example, use by a city cyclist who uses the bicycle only in the city and for short journeys—although, sometimes, he or she needs greater support because he or she is not trained to stay in the saddle; an average padding version is shown in FIG. 5B, if the garment is provided for more intense use and over a longer time, such as for example use by a touring cyclist who uses the bicycle for longer and more demanding rides; and a high padding version is shown in FIG. 5C, if the garment is provided for intense use prolonged over time such as, for example, by professional or amateur cyclists who use the bicycle for many hours a day.

The protective pad 5 is made in different versions in addition to those shown previously, depending on the degree of shock absorption that it is desired to obtain; in fact, the different padding versions have different heights and densities so as to offer users a range of protective pads, depending on the requirements, weight, habits and needs of the cyclist.

In addition to what has been illustrated up until now, the garment in question intends to succeed in modifying the concept of padding and protection. In fact, the tendency of many bottoms on the market in trousers for cyclists is to add padding whereas the garment in question removes the padding because the supporting points are just a few and essential as must be the structure that is worn especially in a sport where every gram can make a difference.

Further, the padding of the protective pad can be made of: a polymer, a polyfunctional copolymer, a sheet polymer, polyurethane, expanded foam, crosslinked polyurethane, foam rubber, closed-cell polyurethane foam, thermoplastic polymer material, elastomers, synthetic rubber, silicone, polysulphide, polyethers, gel (in a plastic pad), cotton, latex, a 3D nylon structure or several coupled materials, or combinations of the preceding materials.

Figure 4:
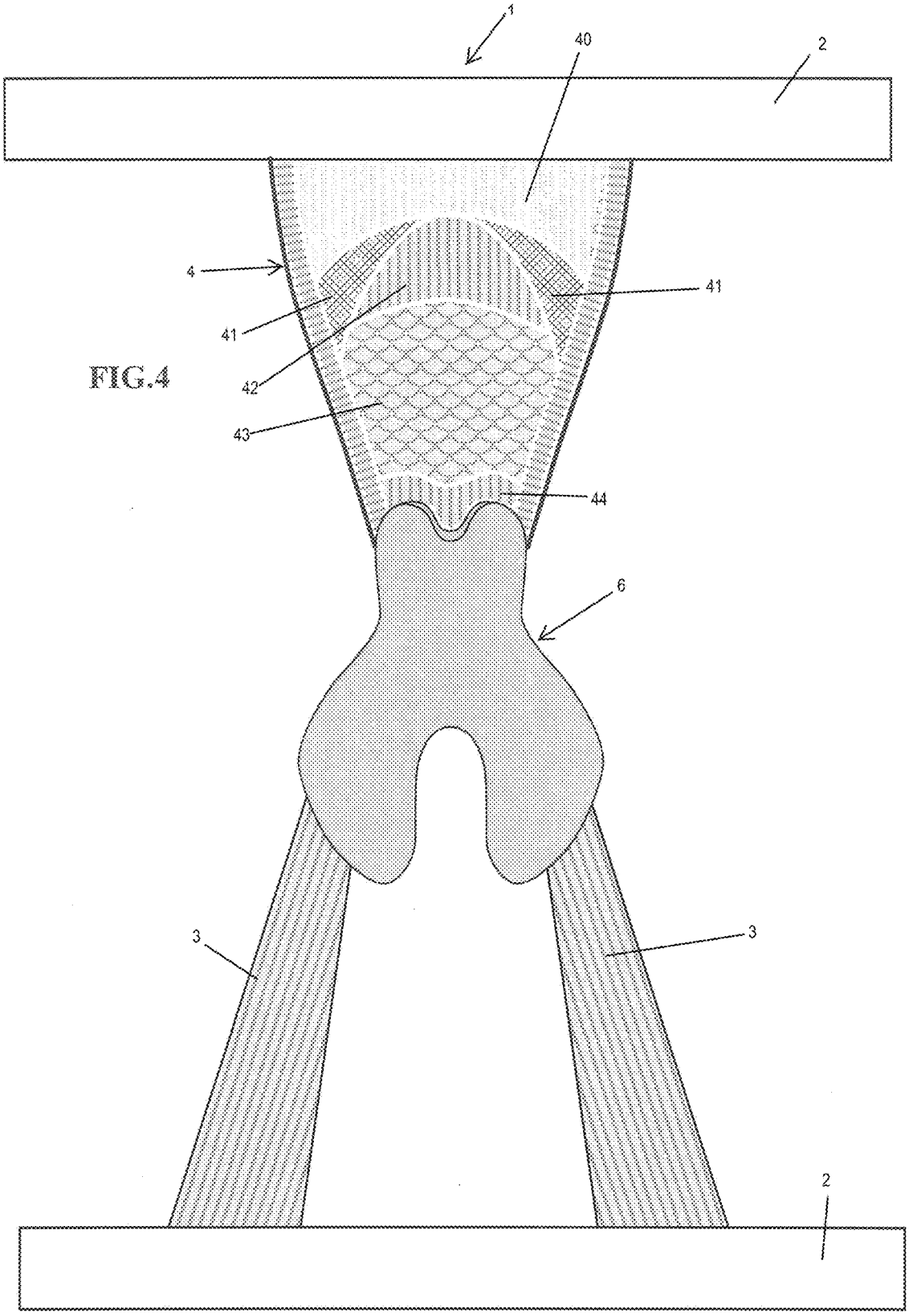
FIG. 4 shows in a schematic manner an overall view of a version of the garment in question.

In addition to what has been illustrated up until now, the protective pad 5 can be removable and in this case it is inserted into a pocket/case 6 of the same shape engaged in the strips 3 and in the fifth zone of the front portion 4, as shown in FIG. 4. In particular, the pocket/case 6 enables the protective pad 5 to be changed easily to so as to easily have the correct and suitable protection and padding for a city bike and replace it with a more padded pad for bike touring using the same garment. In fact, the protective pad becomes interchangeable for different uses, for a more or less prolonged use of the bicycle having different degrees of elasticity, and, as already said, different thicknesses.

In particular, in this case, the protective pad 5 will not be in direct contact with the skin or with the garments whereas it is when it is integrated.

More in detail, the upper face of the pocket/case 6 can have a coating of silicone that reduces/prevents the reciprocal/relative movements between the pocket and the underwear of the cyclist.

The lower face is made of a material that resists abrasion/scratching, in case of violent contact with the stitching of the trousers.

The upper of the inner faces of the pocket (which touch the protective pad directly) must ensure adhesion between the pocket and pad so that it rests in an "anatomical" position and does not stick to the trousers.

Another version involves the use of the garment with the pocket/case 6 but without the use of the underpants so that the lower face of the pocket has a silicone coating to prevent movements with the trousers.

According to the present embodiment, the protective pad has a silicone print on the outer face to ensure a better grip if the protective pad is integrated into the garment.

In fact, for professional cyclists the protective pad is without a pocket/case, thus being directly in contact with the private parts and the silicone coating is in contact with the shorts.

The protective pad is of very reduced dimensions compared with existing protections integrated into cycling trousers and protects the perineal zone and the ischial bones of the user.

The garment in question is a protection that is suitable for those who have decided to use the bicycle as a means of transport. In fact, the garment in question is worn above the cyclist's underwear, to which it adheres perfectly thanks to the non-slip coating that makes garment in question more stable, limiting the uncomfortable friction between the protective pad and garments. During pedaling, it ensures the correct shock absorption on all types of roads and once the destination has been reached, with a simple action, it can be removed and placed in a special case. The minute proportions have been specially designed to ensure minimum encumbrance without forgetting the correct and appropriate shock absorption where necessary. In particular, if during the journey a short comfort break is needed, the garment in question will ensure the most absolute privacy as it is practically invisible under the clothes.

The particular structure of the garment makes it particularly light and comfortable. In the lightest version it takes into account the needs of those who use the bicycle for small journeys or to go to work for whom the garment in question is worn above the underpants and can be removed simply by the closing means located in the elastic edge. In this manner, it will not be necessary to undress, an operation that could take time. The protective pad is inserted into the pocket/case 6, to which it adheres perfectly. In this manner, washing and possible replacement are facilitated if it is decided to use a protective pad with different padding.

After what has been disclosed in a mainly structural sense, the operation of the invention in question is as follows.

When a user wishes to go on a short journey or long journey by bicycle without problems, discomfort, possibilities of traumas, etc., the user needs to merely put on the garment in question either above underpants to be able to then remove the garment easily upon arrival, for example at the workplace, or next to the skin and then don cycling or normal trousers.

The user, once he or she has donned the garment in question and a pair of trousers, can sit on the saddle and start pedaling.

Upon arrival at the destination, the cyclist can, if he or she wishes, remove the garment that has enabled him or her to be on the saddle comfortably by simply acting on the closing means found on the elastic edge and remove the garment.

The present invention thus achieves the proposed objects.

The garment for cyclists in question is able to offer optimum protection of the genital, perineal and ischial zones of both professional and amateur cyclists but above all of those who use the bicycle as a means of transport as it adapts perfectly to the shape of the body of the person and fills every possible space between the body and saddle and also forms an extremely comfortable pad between the body and the saddle.

Advantageously, the garment according to the present invention enables mechanical cutaneous, bone and muscular stress to the cyclist to be reduced considerably, in addition to avoiding bruising phenomena to both the testicles and body ducts.

In addition, the garment is donned and removed simply and rapidly to offer comfort and protection when the cyclist is on the saddle and avoids unappealing and bulky padding on the trousers as occurs with bottoms and trousers for cyclists of the prior art and further, it may motivate and stimulate many other persons to use bicycles as special padded trousers do not necessarily have to be donned and at the same time the cyclist is protected from contact with the saddle.

One advantage obtained with the present garment is that it enhances the performance of the cyclist inasmuch as the disturbance and discomfort elements are reduced compared with prior art bottoms and trousers.

Another advantage of the present garment stems from the fact that it induces the user to take up a position that tends to be tilted forwards and downwards on the saddle, keeping the rear part raised. There is further no need to have to eliminate the front (nose) element of the saddle, thus leaving the thighs a support during lateral movements. In particular, the garment in question enables the pelvis to be raised at the rear (position corresponding to the ischial tuberosities) and lifts/alleviates the rear part of the rest, also permitting greater rotation of the pelvis.

In particular, by reducing the stress factors also, the status after the pedaling activity is improved, enabling cyclists with problems that have become chronic to recover a large part of their physical condition.

With the present garment what happened with prior art trousers no longer occurs, where the cyclist was led or forced to vary his or her position on the saddle in the presence of discomfort or pain and this behavior led to phenomena of irritation of the muscles and joints of anatomical structures that were not directly in contact with the saddle such as the adductors and/or the knee.

One of the advantages offered by this garment is without question that of being able to wear the garment with any trousers so that a new way of dressing can arise as cyclists are no longer constrained to use trousers with an integrated protection but can use any garment that they deem to be suitable for the habits or needs of cyclists.

In particular, with the garment in question a cyclist no longer needs to worry about having to discard new trousers by having to replace the bottom that is incorporated into the trousers if the bottom becomes worn out as the garment according to the present invention can be worn directly in contact with the skin, under any type of trousers.

A further advantage is due to the fact that the garment for cyclists is easy to make and of good functionality.

Naturally, numerous modifications to and variations of this invention can be made, all of which are part of the inventive concept that characterizes the invention.

The invention claimed is:

1. A garment for a cyclist, the garment comprising:

an elasticized or elastic edge configured to adhere to a body of the cyclist so as to ensure that an entire structure of the garment does not move during pedaling;

a front portion configured to be positioned on a genital zone of the cyclist;

a rear portion; and a protective pad, wherein:

a first end of the front portion is engaged with the protective pad, and a second end of the front portion is connected to a front part of the elasticized or elastic edge;

the front portion has a trapezoidal shape and a series of zones including a first zone which is in contact with the elasticized or elastic edge and a second zone which has a texture that is different from a texture of the first zone, the series of zones being configured to offer breathability, containment, and support;

the rear portion includes a pair of strips made of woven material, elastics or another textile configured to rest against buttocks of the cyclist, a first end of the rear portion is engaged with a rear part of the elasticized or elastic edge, and a second end of the rear portion is engaged with the protective pad;

the protective pad is shaped and located between the front portion and the pair of strips;

the protective pad has padding having a thickness which is greater towards a center of the padding which is configured to be located where the buttocks of the cyclist rest on a saddle of a bicycle and is configured to protect a perineal zone and ischial bones of the cyclist;

the protective pad is connected to the rear part of the elasticized or elastic edge by the pair of strips so as to define an opening in the garment; and the opening extends from the protective pad to the rear part of the elasticized or elastic edge between the pair of strips.

2. The garment according to claim 1, wherein:

the protective pad is built into the garment and has a front end and a rear end;

the front end of the protective pad is engaged on the front portion; and the rear end of the protective pad is engaged on the pair of strips.

3. The garment according to claim 1, wherein the series of zones further includes:

a third zone adjoined by the second zone;

a fourth zone; and a fifth zone for anchoring the protective pad, the fifth zone being between the fourth zone and the pair of strips.

4. The garment according to claim 3, wherein:

the garment is a male garment configured to be worn by a male cyclist; and the third zone and the fourth zone define a shell for receiving the genital zone of the cyclist so as to induce the genital zone of the cyclist to adopt a raised and compact position in the saddle of the bicycle and space the genital zone of the cyclist away from thighs of the cyclist.

5. The garment according to claim 1, wherein the protective pad comprises:

a central anti-collapsing channel configured to prevent two side portions of the protective pad folding on each other and including at least one ventilating sector for enabling an air flow so as to eliminate overheating of the perineal zone of the cyclist; and shaped and padded side portions on respective sides of the central anti-collapsing channel divided into two parts including:

i) a first front part including a first padding which is arranged parallel to a front part of the central anti-collapsing channel with differentiated thickness and with at least one pair of first reinforcements; and ii) a second rear part having an open recess and a second padding increasing in thickness toward a center of the second padding with at least one pair of second reinforcements.

6. The garment according to claim 5, wherein each of the at least one pair of first reinforcements and the at least one pair of second reinforcements has a padding thickness that is greater than in other zones of the protective pad and can be pierced so as to be breathable.

7. The garment according to claim 1, wherein the protective pad is interchangeable such that the thickness of the padding can be increased based on a level of protection desired by the cyclist.

8. The garment according to claim 1, wherein the padding is made of a polymer.

9. The garment according to claim 1, wherein:

the protective pad is removable so as to be configured to:

i) be out of direct contact with skin of the cyclist or with an outer garment of the cyclist; and ii) be inserted into a pocket or case of a same shape as the protective pad such that the protective pad is interchangeable, the pocket or case being engaged with the pair of strips and the front portion.

10. The garment according to claim 9, wherein:

an outer face of the protective pad has a coating of silicone for ensuring grip on trousers of the cyclist;

an upper face of the pocket or case has a coating of silicone for reducing or preventing reciprocal or corresponding movements between the pocket or case and the genital zone of the cyclist;

a lower face of the pocket or case: i) is made of a material that is resistant to abrasion or rubbing; or ROOM has a silicone coating for preventing movements of the protective pad with the trousers of the cyclist;

inner faces of the pocket or case directly contact the protective pad; and the inner faces of the pocket or case are configured to ensure adhesion between the pocket or case and the protective pad so that the protective pad remains in position and is configured so as not to be attached to the trousers of the cyclist.

11. The garment according to claim 1, wherein the padding is made of polyurethane.

12. The garment according to claim 1, wherein the padding is made of foam.

13. The garment according to claim 1, wherein the padding is made of rubber.

14. The garment according to claim 1, wherein the padding is made of silicone.

15. The garment according to claim 1, wherein the padding is made of gel.

16. The garment according to claim 1, wherein the padding is made of cotton.

17. The garment according to claim 1, wherein the padding is made of latex.

18. The garment according to claim 1, wherein the padding is made of nylon.

* * * * *